US010242819B1

(12) United States Patent
Lee et al.

(10) Patent No.: US 10,242,819 B1
(45) Date of Patent: Mar. 26, 2019

(54) MECHANICAL KEY STRUCTURE

(71) Applicant: Primax Electronics Ltd., Taipei (TW)

(72) Inventors: Chia-Feng Lee, Taipei (TW); Chin-Sung Pan, Taipei (TW); Lei-Lung Tsai, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/865,652

(22) Filed: Jan. 9, 2018

(30) Foreign Application Priority Data

Sep. 22, 2017 (TW) ..... 106132651 A

(51) Int. Cl.
*H01H 13/14* (2006.01)
*H01H 13/7065* (2006.01)
*H01H 3/12* (2006.01)

(52) U.S. Cl.
CPC ..... *H01H 13/7065* (2013.01); *H01H 3/125* (2013.01); *H01H 13/14* (2013.01)

(58) Field of Classification Search
CPC .... H01H 3/125; H01H 13/83; H01H 13/7065; H01H 2219/062; H01H 2221/04
USPC ..... 200/5 A, 334
See application file for complete search history.

(56) References Cited

U.S. PATENT DOCUMENTS 5,821,482 A * 10/1998 Ootani ..... H01H 13/705 200/5 A
2013/0220786 A1* 8/2013 Niu ..... H01H 3/125 200/344
2015/0014140 A1* 1/2015 Liu ..... H01H 13/14 200/517

* cited by examiner

*Primary Examiner* — Ahmed M Saeed
(74) *Attorney, Agent, or Firm* — Muncy, Geissler, Olds & Lowe, P.C.

(57) ABSTRACT

A key structure includes a supporting plate, a triggering switch, a keycap and a soft element. The triggering switch is located over the supporting plate. The keycap is located over the triggering switch. When an external force is received by the keycap, the triggering switch is pushed by the keycap. The soft element is disposed on an inner surface of the keycap. When the soft element is contacted with the triggering switch, the soft element is subjected to deformation. When the soft element is contacted with the triggering switch, a portion of the triggering switch is inserted into the deformed soft element to limit a sliding action of the triggering switch. Consequently, the mechanical key switch provides enhanced tactile feel.

8 Claims, 7 Drawing Sheets

MECHANICAL KEY STRUCTURE

FIELD OF THE INVENTION

The present invention relates to a key structure, and more particularly to a key structure with a scissors-type connecting element.

BACKGROUND OF THE INVENTION

Generally, the widely-used peripheral input device of a computer system includes for example a mouse, a keyboard, a trackball, or the like. Via the keyboard, characters or symbols can be directly inputted into the computer system. As a consequence, most users and most manufacturers of input devices pay attention to the development of keyboards. A keyboard with scissors-type connecting elements is one of the widely-used keyboards.

Hereinafter, a key structure with a scissors-type connecting element in a conventional keyboard will be illustrated with reference to FIG. 1. FIG. 1 is a schematic cross-sectional side view illustrating a conventional key structure. As shown in FIG. 1, the conventional key structure 1 comprises a keycap 11, a scissors-type connecting element 12, a rubbery elastomer 13, a membrane switch circuit member 14 and a base plate 15. The keycap 11, the scissors-type connecting element 12, the rubbery elastomer 13 and the membrane switch circuit member 14 are supported by the base plate 15. The scissors-type connecting element 12 is used for connecting the base plate 15 and the keycap 11.

The membrane switch circuit member 14 comprises plural key intersections (not shown). When one of the plural key intersections is triggered, a corresponding key signal is generated. The rubbery elastomer 13 is disposed on the membrane switch circuit member 14. Each rubbery elastomer 13 is aligned with a corresponding key intersection. When the rubbery elastomer 13 is depressed, the rubbery elastomer 13 is subjected to deformation to push the corresponding key intersection of the membrane switch circuit member 14. Consequently, the corresponding key signal is generated.

The scissors-type connecting element 12 is arranged between the base plate 15 and the keycap 11, and the base plate 15 and the keycap 11 are connected with each other through the scissors-type connecting element 12. The scissors-type connecting element 12 comprises a first frame 121 and a second frame 122. A first end of the first frame 121 is connected with the keycap 11. A second end of the first frame 121 is connected with the base plate 15. The rubbery elastomer 13 is enclosed by the scissors-type connecting element 12. Moreover, the first frame 121 comprises a first keycap post 1211 and a first base post 1212. The first frame 121 is connected with the keycap 11 through the first keycap post 1211. The first frame 121 is connected with the base plate 15 through the first base post 1212. The second frame 122 is combined with the first frame 121. A first end of the second frame 122 is connected with the base plate 15. A second end of the second frame 122 is connected with the keycap 11. Moreover, the second frame 122 comprises a second keycap post 1221 and a second base post 1222. The second frame 122 is connected with the keycap 11 through the second keycap post 1221. The second frame 122 is connected with the base plate 15 through the second base post 1222.

The operations of the conventional key structure 1 in response to the depressing action of the user will be illustrated as follows. Please refer to FIG. 1 again. When the keycap 11 is depressed, the keycap 11 is moved downwardly to push the scissors-type connecting element 12 in response to the depressing force. As the keycap 11 is moved downwardly relative to the base plate 15, the keycap 11 pushes the corresponding rubbery elastomer 13. At the same time, the rubbery elastomer 13 is subjected to deformation to push the membrane switch circuit member 14 and trigger the corresponding key intersection of the membrane switch circuit member 14. Consequently, the membrane switch circuit member 14 generates a corresponding key signal. When the keycap 11 is no longer depressed by the user, no external force is applied to the keycap 11 and the rubbery elastomer 13 is no longer pushed by the keycap 11. In response to the elasticity of the rubbery elastomer 13, the rubbery elastomer 13 is restored to its original shape to provide an upward elastic restoring force. Consequently, the keycap 11 is returned to its original position where it is not depressed.

In addition to the above keyboard with scissors-type connecting elements, another conventional keyboard with a mechanical key structure is introduced into the market. FIG. 2 is a schematic cross-sectional side view illustrating a conventional mechanical key structure. As shown in FIG. 2, the conventional mechanical key structure 2 comprises a keycap 21, a scissors-type connecting element 22, a triggering switch 23, a circuit board 24 and a base plate 25. The base plate 25 is connected with the keycap 21 through the scissors-type connecting element 22. The circuit board 24 is located under the base plate 25. The triggering switch 23 is supported by the circuit board 24. In addition, the circuit board 24 is electrically connected with the triggering switch 23. The triggering switch 23 is penetrated through the base plate 25 and the scissors-type connecting element 22, and contacted with the keycap 21. After the above components are combined with each other, the key structure 2 is assembled. The components of the key structure 2 from top to bottom include the keycap 21, the scissors-type connecting element 22, the base plate 25 and the circuit board 24 sequentially. The triggering switch 23 is arranged between the keycap 21 and the circuit board 24. In comparison with the key structure 1, the key structure 2 comprises the triggering switch 23 in replace of the rubbery elastomer 13 and the membrane switch circuit member 14.

When the triggering switch 23 is triggered by the keycap 21, a click sound is generated. Due to the click sound, the user can feel the depressing feedback. Consequently, the triggering switch 23 is favored by many users. However, when the keycap 21 is depressed, the metallic material and the plastic material in the triggering switch 23 may collide with each other. Under this circumstance, the conventional mechanical key structure 2 give a stiff feel to the user. Moreover, during the operation of the conventional mechanical key structure 2, the upper portion of the triggering switch 23 is possibly slid. The sliding action of the triggering switch 23 may adversely affect the tactile feel of the mechanical key structure 2 and reduce the click sound.

Therefore, there is a need of providing a mechanical key structure with enhanced tactile feel.

SUMMARY OF THE INVENTION

An object of the present invention provides a mechanical key structure with enhanced tactile feel.

In accordance with an aspect of the present invention, there is provided a key structure. The key structure includes a supporting plate, a triggering switch, a keycap and a soft element. The triggering switch is located over the supporting plate. The triggering switch is triggered in response to an external force. The keycap is located over the triggering switch. When the external force is received by the keycap, the triggering switch is pushed by the keycap. The soft element is disposed on an inner surface of the keycap. When the soft element is contacted with the triggering switch, the soft element is subjected to deformation. When the soft element is contacted with the triggering switch, a portion of the triggering switch is inserted into the deformed soft element to limit a sliding action of the triggering switch.

In accordance with another aspect of the present invention, there is provided a key structure. The key structure includes a supporting plate, a triggering switch and a keycap. The triggering switch is located over the supporting plate. The triggering switch is triggered in response to an external force. The keycap is located over the triggering switch and contacted with the triggering switch. When the external force is received by the keycap, the triggering switch is pushed by the keycap. The keycap includes a concave part. The concave part is formed in an inner surface of the keycap and contacted with the triggering switch. The triggering switch is inserted into the concave part to limit a sliding action of the triggering switch.

From the above descriptions, the present invention provides the mechanical key structure. In an embodiment, the soft element corresponding to the protrusion part is arranged between the keycap and the triggering switch. In another embodiment, the concave part corresponding to the protrusion part is formed in the inner surface of the keycap. Consequently, the protrusion part of the triggering switch is allowed to be moved in the range of the soft element or the concave part along the vertical direction. Consequently, the problem of sliding the triggering switch is avoided. In other words, the mechanical key structure of the present invention provides enhanced tactile feel.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For solving the drawbacks of the conventional technologies, the present invention provides a mechanical key structure with enhanced tactile feel.

Figure 1:
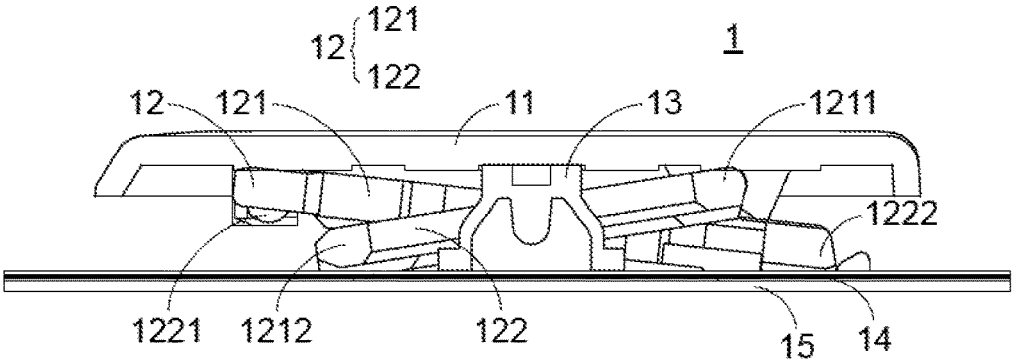
FIG.1 PRIOR ART
FIG. 1 is a schematic cross-sectional side view illustrating a conventional key structure.
Figure 2:
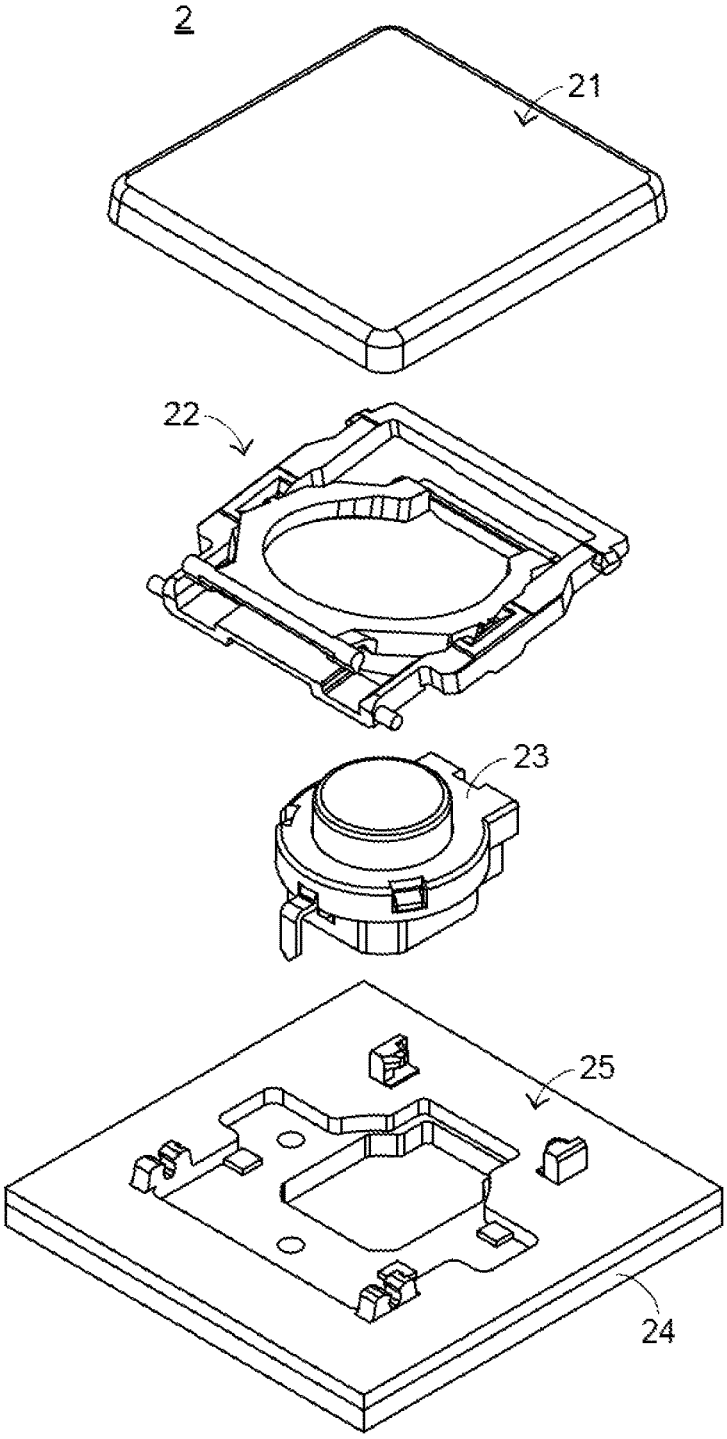
FIG.2 PRIOR ART
FIG. 2 is a schematic cross-sectional side view illustrating a conventional mechanical key structure.
Figure 3:
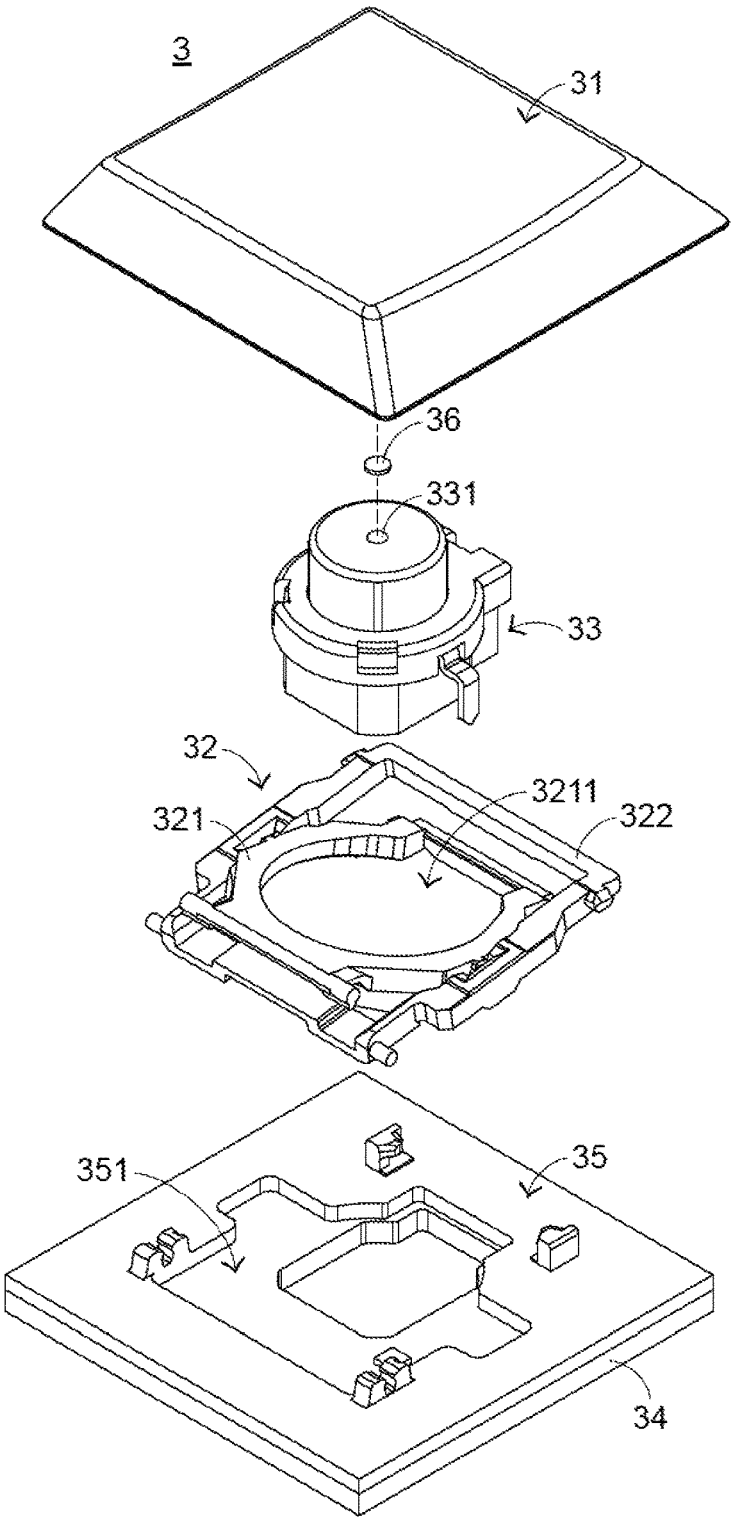
FIG. 3 is a schematic exploded view illustrating a mechanical key structure according to a first embodiment of the present invention.

FIG. 3 is a schematic exploded view illustrating a mechanical key structure according to a first embodiment of the present invention. As shown in FIG. 3, the mechanical key structure 3 comprises a keycap 31, a scissors-type connecting element 32, a triggering switch 33, a circuit board 34, a supporting plate 35 and a soft element 36.

The triggering switch 33 is located over the supporting plate 35. In response to an external force, the triggering switch 33 is triggered to generate a key signal. The triggering switch 33 comprises a protrusion part 331. The protrusion part 331 is disposed on a top end of the triggering switch 33. The keycap 31 is located over the triggering switch 33. The keycap 31 is movable upwardly or downwardly relative to the supporting plate 35. When the external force is exerted on the keycap 31, the keycap 31 is moved downwardly to push the triggering switch 33. The supporting plate 35 comprises a supporting plate opening 351 corresponding to the triggering switch 33. The triggering switch 33 is inserted into the supporting plate opening 351. The circuit board 34 is located under the supporting plate 35 and electrically connected with the triggering switch 33. When the triggering switch 33 is triggered, the key signal is generated and transmitted to the circuit board 34. In an embodiment, the circuit board 34 is a printed circuit board (PCB).

The scissors-type connecting element 32 is connected with the keycap 31 and the supporting plate 35. The scissors-type connecting element 32 comprises a first frame 321 and a second frame 322. A first end of the first frame 321 is connected with the keycap 31. A second end of the first frame 321 is connected with the supporting plate 35. The first frame 321 has a frame opening 3211. The triggering switch 33 is penetrated through the frame opening 3211. Moreover, the two ends of the triggering switch 33 are contacted with the soft element 36 and the circuit board 34, respectively. The second frame 322 is combined with the first frame 321. The second frame 322 can be swung relative to the first frame 321. A first end of the second frame 322 is connected with the supporting plate 35. A second end of the second frame 322 is connected with the keycap 31.

Figure 4:
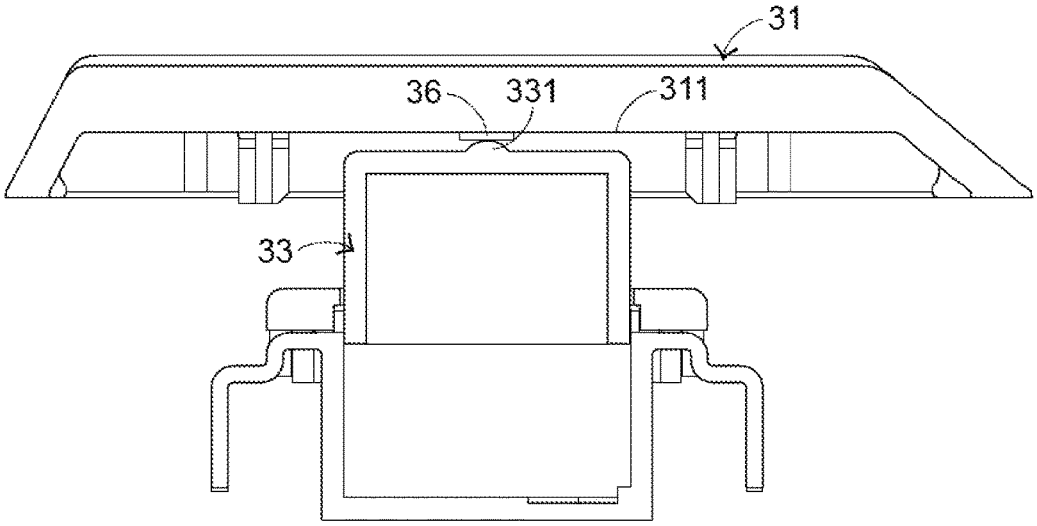
FIG. 4 is a schematic cross-sectional side view illustrating a portion of the mechanical key structure according to the first embodiment of the present invention.

Please refer to FIGS. 3 and 4. FIG. 4 is a schematic cross-sectional side view illustrating a portion of the mechanical key structure according to the first embodiment of the present invention. The soft element 36 is disposed on an inner surface 311 of the keycap 31. When the soft element 36 is contacted with the protrusion part 331 of the triggering switch 33, the soft element 36 is subjected to deformation. That is, when the soft element 36 is contacted with the triggering switch 33, the protrusion part 331 of the triggering switch 33 is inserted into the deformed soft element 36 to limit the sliding action of the triggering switch 33. Preferably, the size of the soft element 36 is slightly larger than the size of the protrusion part 331. In an embodiment, the soft element 36 is made of a rubbery material or a sponge material. Moreover, the soft element 36 is adhered and fixed on the inner surface 311 of the keycap 31.

Please refer to FIGS. 3 and 4 again. The operations of the mechanical key structure 3 in response to the depressing action of the user will be illustrated as follows. While the keycap 31 is depressed by the user, the keycap 31 is moved downwardly to push the scissors-type connecting element 32 in response to the depressing force. Consequently, the scissors-type connecting element 32 is activated. As the keycap 31 is moved downwardly relative to the supporting plate 35, the soft element 36 on the inner surface 311 of the keycap 31 presses protrusion part 331 of the triggering switch 33. Meanwhile, the triggering switch 33 is triggered to generate the key signal to the circuit board 34. In addition, the metallic elastic material (not shown) and the plastic material (not shown) within the triggering switch 33 collide with each other to generate the click sound.

When the keycap 31 is no longer depressed by the user, no external force is applied to the keycap 31 and the triggering switch 33 is no longer pushed by the soft element 36. In response to the elasticity of the metallic elastic material within the triggering switch 33, the triggering switch 33 is restored to its original shape to provide an upward pushing force. In response to the upward pushing force, the keycap 31 is returned to its original position where it is not depressed.

While the keycap 31 is moved downwardly, the soft element 36 is pushed by the protrusion part 331 of the triggering switch 33. Since the soft element 36 is subjected to deformation, the protrusion part 331 can be accommodated within the soft element 36. Due to the soft element 36, the triggering switch 33 is allowed to be moved in the vertical direction only. Under this circumstance, the problem of sliding the triggering switch 33 is avoided. Moreover, the soft property of the soft element 36 can alleviate the stiff feel of the triggering switch 33. Consequently, the tactile feel is enhanced.

Figure 5:
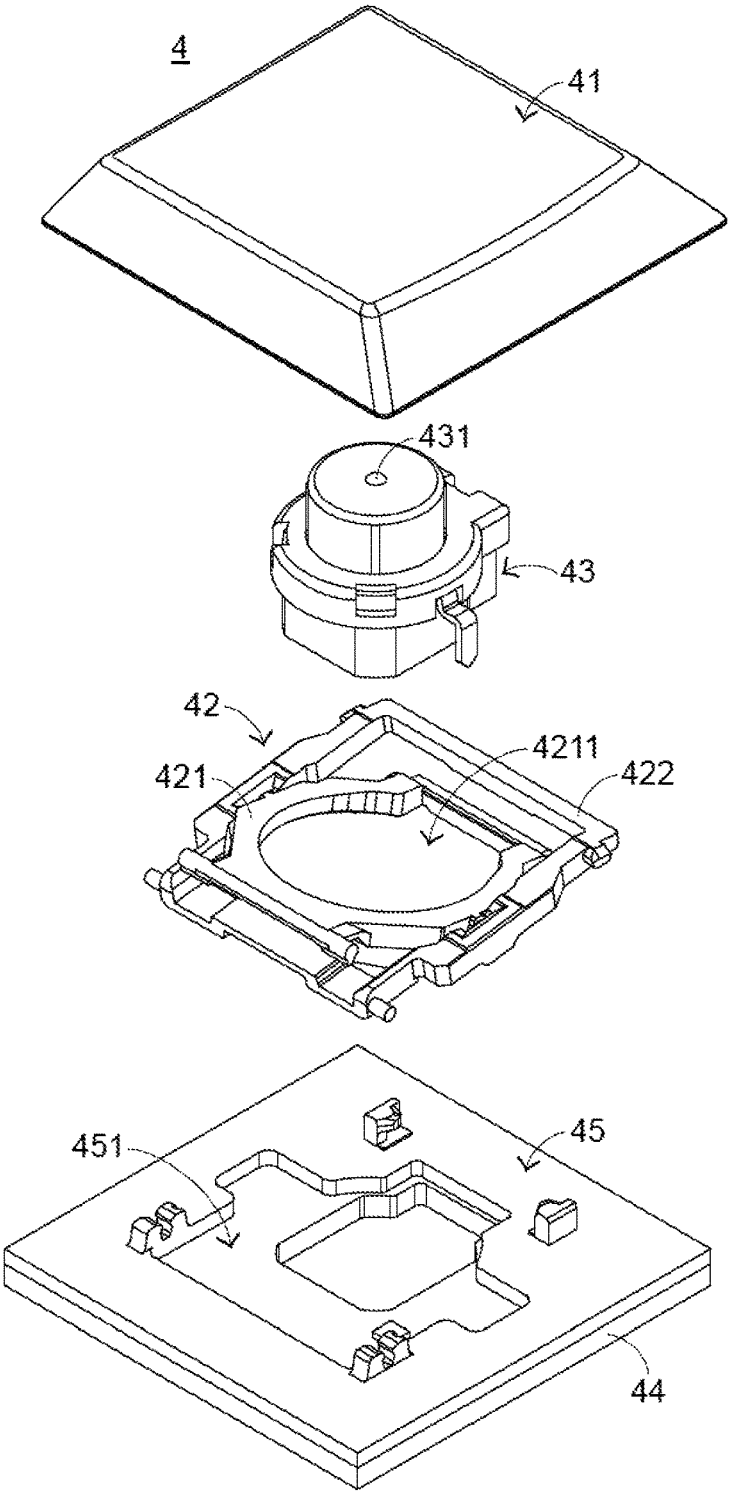
FIG. 5 is a schematic exploded view illustrating a mechanical key structure according to a second embodiment of the present invention.
Figure 6:
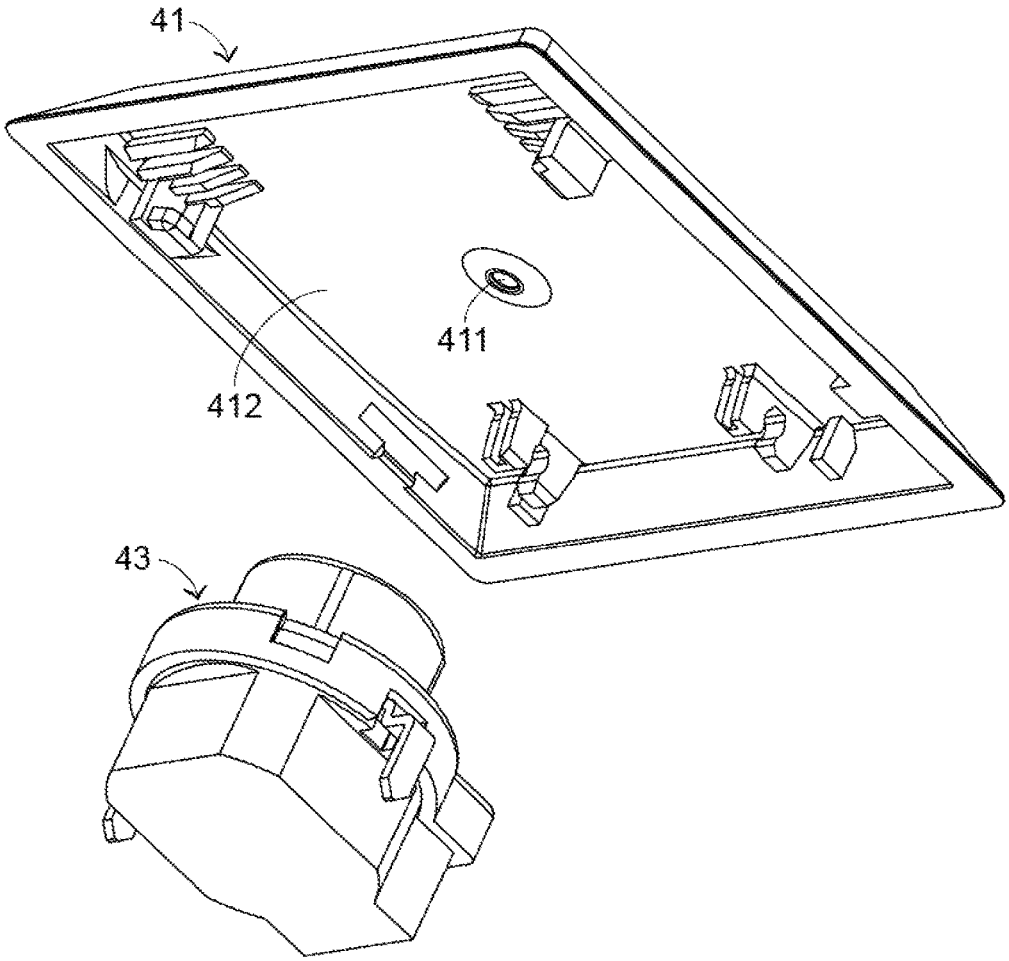
FIG. 6 is a schematic exploded view illustrating a portion of the mechanical key structure according to the second embodiment of the present invention.

The present invention further provides a second embodiment, which is distinguished from the first embodiment. FIG. 5 is a schematic exploded view illustrating a mechanical key structure according to a second embodiment of the present invention. FIG. 6 is a schematic exploded view illustrating a portion of the mechanical key structure according to the second embodiment of the present invention. As shown in FIGS. 5 and 6, the mechanical key structure 4 comprises a keycap 41, a scissors-type connecting element 42, a triggering switch 43, a circuit board 44 and a supporting plate 45. The scissors-type connecting element 42 comprises a first frame 421 and a second frame 422. The first frame 421 has a frame opening 4211. The triggering switch 43 comprises a protrusion part 431. The supporting plate 45 comprises a supporting plate opening 451 corresponding to the triggering switch 43. The structures and functions of the components of the key structure 4 which are identical to those of the first embodiment are not redundantly described herein. In comparison with the first embodiment, the key structure 4 of this embodiment is not equipped with the soft element and the structure of the keycap 41 is distinguished.

Figure 7:
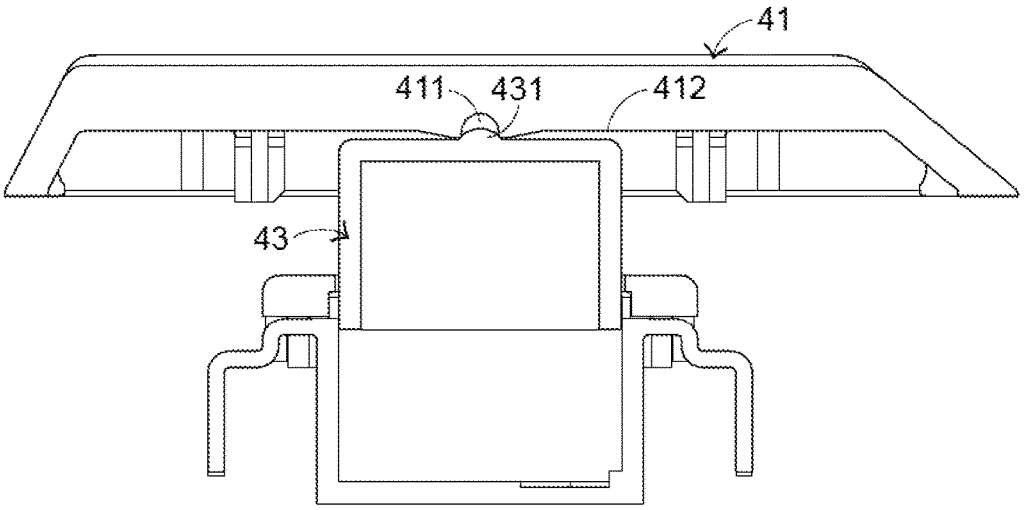
FIG. 7 is a schematic cross-sectional side view illustrating a portion of the mechanical key structure according to the second embodiment of the present invention.

The structure of the keycap 41 will be described as follows. Please refer to FIGS. 5, 6 and 7. FIG. 7 is a schematic cross-sectional side view illustrating a portion of the mechanical key structure according to the second embodiment of the present invention. As shown in FIGS. 6 and 7, the keycap 41 comprises a concave part 411. The concave part 411 is formed in an inner surface 412 of the keycap 41 and contacted with the triggering switch 43. That is, the protrusion part 431 of the triggering switch 43 is inserted into the concave part 411 of the keycap 41. Consequently, the sliding action of the triggering switch 43 is limited.

The operations of the mechanical key structure 4 in response to the depressing action of the user will be illustrated as follows. While the keycap 41 is depressed by the user, the keycap 41 is moved downwardly to push the scissors-type connecting element 42 in response to the depressing force. Consequently, the scissors-type connecting element 42 is activated. As the keycap 41 is moved downwardly relative to the supporting plate 45, the concave part 411 in the inner surface 412 of the keycap 41 presses the protrusion part 431 of the triggering switch 43. Meanwhile, the triggering switch 43 is triggered to generate the key signal to the circuit board 44. In addition, the metallic elastic material (not shown) and the plastic material (not shown) within the triggering switch 43 collide with each other to generate the click sound. When the keycap 41 is no longer depressed by the user, no external force is applied to the keycap 41 and the triggering switch 43 is no longer pushed by the keycap 41. In response to the elasticity of the metallic elastic material within the triggering switch 43, the triggering switch 43 is restored to its original shape to provide an upward pushing force. In response to the upward pushing force, the keycap 41 is returned to its original position where it is not depressed.

While the keycap 41 is moved downwardly, the protrusion part 431 of the triggering switch 43 is inserted into the concave part 411 of the keycap 41. Since the protrusion part 431 is accommodated within the concave part 411, the triggering switch 43 is allowed to be moved in the vertical direction only. Under this circumstance, the problem of sliding the triggering switch 43 is avoided. Preferably, the size of the concave part 411 matches the size of the protrusion part 431.

From the above descriptions, the present invention provides the mechanical key structure. In an embodiment, the soft element corresponding to the protrusion part is arranged between the keycap and the triggering switch. In another embodiment, the concave part corresponding to the protrusion part is formed in the inner surface of the keycap. Consequently, the protrusion part of the triggering switch is allowed to be moved in the range of the soft element or the concave part along the vertical direction. Consequently, the problem of sliding the triggering switch is avoided. In other words, the mechanical key structure of the present invention provides enhanced tactile feel.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a supporting plate;

a triggering switch located over the supporting plate, wherein the triggering switch is triggered in response to an external force;

a keycap located over the triggering switch, wherein when the external force is received by the keycap, the triggering switch is pushed by the keycap; and a soft element disposed on an inner surface of the keycap, wherein when the soft element is contacted with the triggering switch, the soft element is subjected to deformation, wherein when the soft element is contacted with the triggering switch, a portion of the triggering switch is inserted into the deformed soft element to limit a sliding action of the triggering switch, the triggering switch comprises a protrusion part, the protrusion part is disposed on a top end of the triggering switch, and the protrusion part is inserted into the deformed soft element to limit the sliding action of the triggering switch.

2. The mechanical key structure according to claim 1, further comprising:

a scissors-type connecting element connected with the keycap and the supporting plate, and comprising a first frame and a second frame, wherein a first end of the first frame is connected with the keycap, a second end of the first frame is connected with the supporting plate, the second frame is combined with the first frame and swung relative to the first frame, a first end of the second frame is connected with the supporting plate, and a second end of the second frame is connected with the keycap; and a circuit board located under the supporting plate and electrically connected with the triggering switch, wherein when the triggering switch is triggered, the triggering switch generates a key signal to the circuit board.

3. The mechanical key structure according to claim 2, wherein the first frame has a frame opening, wherein the triggering switch is penetrated through the frame opening, and two ends of the triggering switch are contacted with the soft element and the circuit board, respectively.

4. The mechanical key structure according to claim 1, wherein the soft element is adhered and fixed on the inner surface of the keycap.

5. A key structure, comprising:

a supporting plate;

a triggering switch located over the supporting plate, wherein the triggering switch is triggered in response to an external force; and a keycap located over the triggering switch and contacted with the triggering switch, and comprising a concave part, wherein when the external force is received by the keycap, the triggering switch is pushed by the keycap, wherein the concave part is formed in an inner surface of the keycap and contacted with the triggering switch, the triggering switch is inserted into the concave part to limit a sliding action of the triggering switch, the triggering switch comprises a protrusion part, the protrusion part is disposed on a top end of the triggering switch, and the protrusion part is inserted into the concave part to limit the sliding action of the triggering switch.

6. The mechanical key structure according to claim 5, further comprising:

a scissors-type connecting element connected with the keycap and the supporting plate, and comprising a first frame and a second frame, wherein a first end of the first frame is connected with the keycap, a second end of the first frame is connected with the supporting plate, the second frame is combined with the first frame and swung relative to the first frame, a first end of the second frame is connected with the supporting plate, and a second end of the second frame is connected with the keycap; and a circuit board located under the supporting plate and electrically connected with the triggering switch, wherein when the triggering switch is triggered, the triggering switch generates a key signal to the circuit board.

7. The mechanical key structure according to claim 6, wherein the first frame has a frame opening, wherein the triggering switch is penetrated through the frame opening, and two ends of the triggering switch are contacted with the keycap and the circuit board, respectively.

8. The mechanical key structure according to claim 6, wherein the supporting plate comprises a supporting plate opening, and the triggering switch is penetrated through the supporting plate opening and electrically connected with the circuit board.

* * * * *